United States Patent [19]

Cox et al.

[11] 4,373,836

[45] Feb. 15, 1983

[54] ICE ISLAND CONSTRUCTION

[75] Inventors: Gordon F. N. Cox, Lyme Center; Feng H. Hsu, Tulsa, both of Okla.

[73] Assignee: Standard Oil Company (Indiana), Chicago, Ill.

[21] Appl. No.: 233,349

[22] Filed: Feb. 11, 1981

[51] Int. Cl.[3] ..... E02B 3/00; F25C 1/02

[52] U.S. Cl. ..... 405/217; 62/260; 405/61; 405/195

[58] Field of Search ..... 405/217, 211, 61; 299/24; 62/259.1, 260

[56] References Cited

U.S. PATENT DOCUMENTS

| | | | |
|---|---|---|---|
| 2,737,092 | 3/1956 | Gramelspacher | 404/28 |
| 3,804,543 | 4/1974 | Best | 404/28 |
| 3,849,993 | 11/1974 | Robinson et al. | 405/217 |
| 4,080,797 | 3/1978 | Thompson | 62/260 X |
| 4,094,149 | 6/1978 | Thompson et al. | 405/217 X |
| 4,205,928 | 6/1980 | Thompson et al. | 405/217 |
| 4,242,012 | 12/1980 | Utt | 405/217 |

*Primary Examiner*—Dennis L. Taylor

*Attorney, Agent, or Firm*—John D. Gassett

[57] ABSTRACT

An ice island is constructed in a marine area having a sheet of natural ice by mining ice blocks from the ice sheet, curing the blocks and placing the cured blocks directly on the ice sheet until the natural sheet touches bottom and the desired weight of the ice island is obtained. Methods are disclosed for special placement of the blocks to prevent overstressing the natural ice sheet.

9 Claims, 10 Drawing Figures

ICE ISLAND CONSTRUCTION

RELATED APPLICATION

The subject matter of this invention is related to copending patent application Ser. No. 233,353 entitled "Ice-Island Construction," filed Feb. 11, 1981, Gordon F. N. Cox and Kenneth G. Nolte, inventors.

BRIEF SUMMARY OF THE INVENTION

This invention relates to ice island construction in marine areas covered by natural sea ice. In some parts of the United States off the coast of Alaska, sea ice, which may be six to seven or more feet in thickness, covers a large portion of the ocean immediately surrounding the shore area. This ice sheet may sometimes be attached to the surrounding beaches but more likely it will be detached and some of the ice sheet moves at a slow rate, e.g., two feet per day. Although this is a slow rate, the movement of the ice can exert considerable loads on offshore structures. A lot of the ice sheet is over relatively shallow water, e.g., 20 feet, and covers some of the geological structures which may contain petroleum. Thus, it is desirable to drill oil and gas wells in these areas. This can be done from fixed platforms by making an island out of gravel and the like. However, merely putting the drilling platform on steel piles is not normally satisfactory inasmuch as it is not always possible to build a pile-founded platform of sufficient strength to withstand the force of the moving ice. Other methods which have been suggested are the use of ice islands. The present invention is an improved method of construction of ice islands.

This covers a method of constructing an artificial ice island in a marine body covered at least partially by sheet ice in an environment of subfreezing temperatures. Natural and man-made sea ice is composed of sea ice crystals made up of pure ice, liquid brine inclusions, and solid salts. As the ice temperature or salinity increases, the ice brine volume increases via phase relationships. The greater the ice brine volume, the weaker the ice. Fresh water ice is also stronger than sea ice. Further, brine tends to migrate in ice from top to bottom and weakens the bottom of the ice.

In our preferred embodiment for constructing an artificial ice island, we first mine blocks of ice from the natural ice sheet in the surrounding area. We then cool these mined blocks by stacking or storing them such that the air has contact with a good part of the ice block. Inasmuch as the ice blocks are relatively small, e.g., $2\times4\times6$ feet, the blocks will rapidly approach the ambient temperature.

The ice island is built by stacking ice blocks directly on top of the sheet ice on the selected area for the island without any step of first building up a lower level by normal flooding and freezing. In one embodiment we construct a ring of ice blocks about the area selected and then fill in the interior of the ring in a systematic manner to minimize the deflection of the ice sheet inside the ring. A ring is cut around the selected area to separate the ice island from the surrounding ice to eliminate or prevent deflections in the surrounding natural ice sheet as the selected island area is sunk by the weight of the ice blocks.

In what may be my preferred embodiment, we construct a small rectangular shaped island section by stacking ice blocks on an area small enough so that the natural ice does not fail within the area if a trench is cut through the ice sheet around the section. We then build additional sections until the desired size of the island is obtained.

A better understanding of the invention can be had from the following description taken in conjunction with the drawings.

DRAWINGS

DETAILED DESCRIPTION OF THE INVENTION

Figure 1:
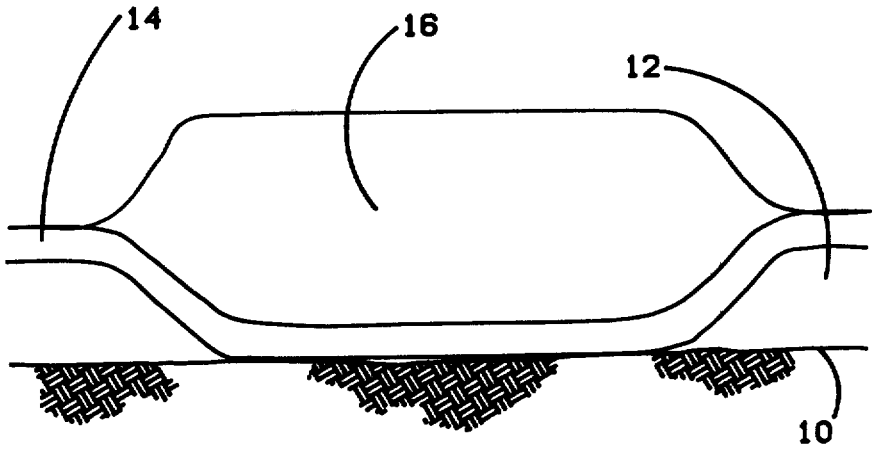
FIG. 1 illustrates an ice island made by constructed ice on top of a natural ice sheet.

In addition to requiring adequate ice strength to resist ice movement, an ice island must have sufficient sliding resistance on the sea floor. This is accomplished by making the island large enough so that the contact area and weight of the island produces the required sliding resistance. Islands on the order of 300 feet in diameter and 50 feet thick have been considered in the public literature. As shown in FIG. 1, an ice island has been made on an area having a sea floor 10, sea water 12, a natural ice sheet 14, and constructed ice 16. This ice island can be constructed by flooding the area on top of ice sheet 14 on which it is desired to produce the ice island. The water is confined to the selected area where it freezes and additional water is continually added until the constructed ice is the desired thickness. As can be seen in FIG. 1, the weight of the constructed ice 16 deforms the layer of the natural ice 14 until eventually it rests on the bottom 10.

Figure 3:
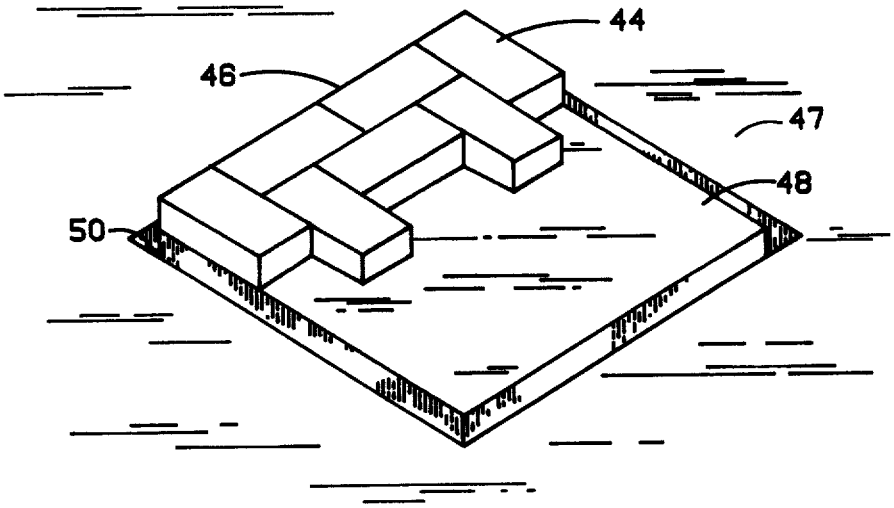
FIG. 3 illustrates the first phase of constructing a section of an ice island from mined ice blocks.
Figure 4:
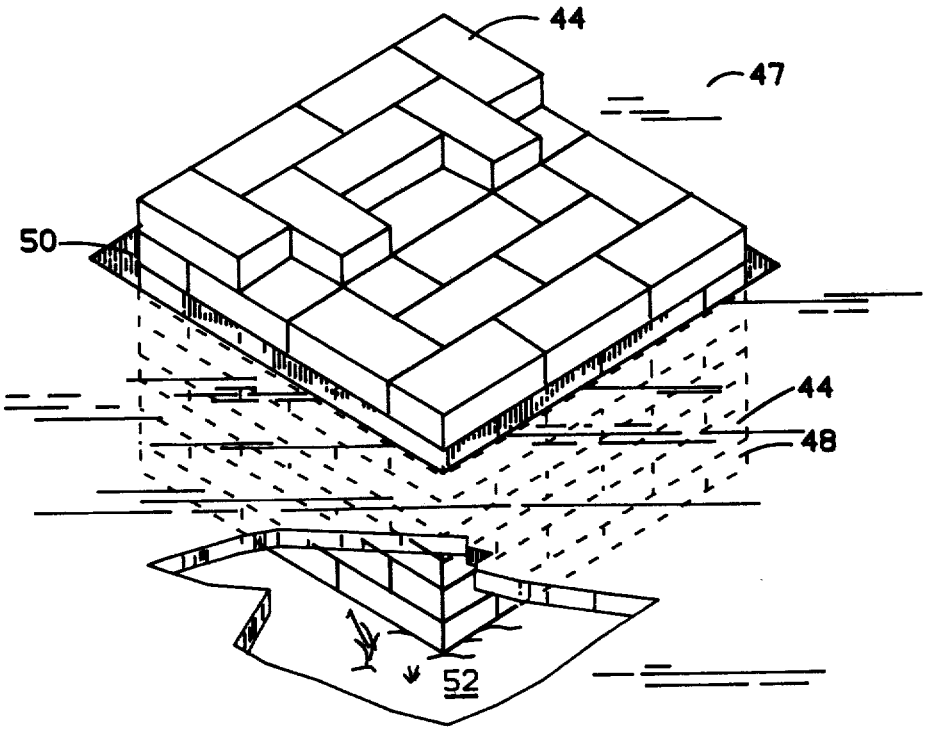
FIG. 4 illustrates the final construction of one section of an ice block island.

Attention is directed to FIG. 3 to illustrate the construction of an ice island from mined ice blocks. An area, which may be in the form of a square 48 on the ice sheet 47, is selected and is covered by a layer 46 of ice blocks 44. A slot 50 is cut in ice sheet 47 completely around area 48 so as to prevent excessive stresses to the surrounding ice sheet 47 as additional layers of ice blocks 44 are added. As shown in FIG. 4, additional layers of ice blocks are added until the "cut-out" area 48 of the ice sheet rests on the sea floor 52. What is illustrated can be described as an ice island section. Additional sections can be built adjacent the previously constructed sections until the desired size of the ice island is obtained.

Figure 2:
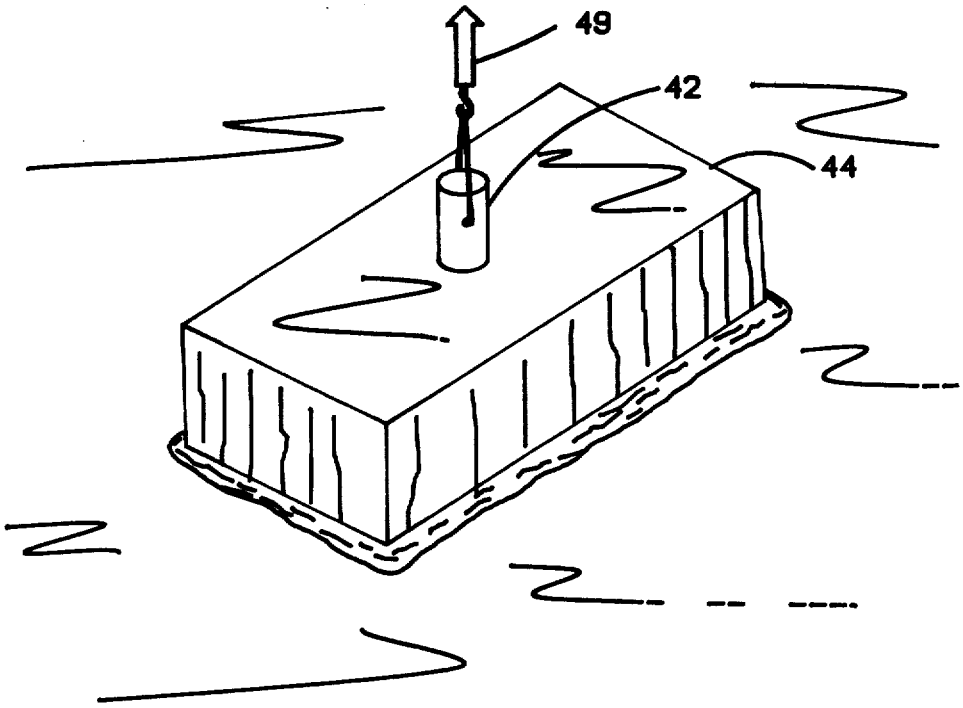
FIG. 2 illustrates lifting first ice block from an ice sheet.

There are four steps needed in the construction of an artificial ice island from mined ice blocks. They include mining, curing, transportation, and bonding. Mining the ice blocks will now be discussed. Mining the ice blocks from a natural ice sheet, such as 47, requires a snow plow, surveying equipment, several ice-cutting machines, and a crane. Since uniform blocks are needed to construct the island, a survey crew first lays out lines on the ice to be cut by the ice trenching machines. Conditions may required that the snow be plowed off the ice surface. Once the cutting lines have been marked on the ice, such as by spray paint, the blocks are cut out by the ice cutting machines. The first block may be removed by coring a hole or holes in the block and freezing in a pipe with holes, a hook or eye bolt at the top end, such as illustrated in FIG. 2. The block 44 is lifted from the ice sheet using a crane with a cable 49 attached to the frozen bolt 42. Subsequent blocks may be removed by using a large bucket or ice tongs attached to the crane. If a 4×8 foot block is excavated from the 2 foot thick ice, a six-ton capacity crane would be required to lift the blocks. Ice cutting machines having cutting speeds up to 10 feet per minute in 4 to 6 foot thick ice have been tested by the Naval Civil Engineering Laboratory.

Once the ice blocks 44 have been excavated from the natural ice sheet, the blocks should be allowed to cure before they are used for construction. This may be accomplished by placing the ice blocks on beams or slat-like material with the natural top up so that cold air substantially surrounds the block. The block is allowed to cool until the lower portion of the block has reached the ambient temperature which may take several days, e.g., seven to ten. As the blocks cool, the concentrated brine in the ice will drain out by brine expulsion and gravity drainage. This decrease in ice temperature and salinity results in higher ice strength. Furthermore, the brine which has drained out of the ice blocks during the curing stage will not later accumulate at the base of the ice island by gravity drainage and cause ice deterioration. The colder temperature of the ice blocks will also facilitate welding them together and produce a stronger ice block bond.

Brine drainage may cause the underside of the ice blocks to be rough and irregular. It may therefore be necessary to turn the blocks over and position them upside down. The rough ice on top may be scraped off with a plow. Placing the blocks in this manner also allows the warmer lower portion of the ice blocks to cool more rapidly. After the blocks have cured, they must be transported and positioned at the construction site. Large payloaders equipped with a fork lift and crane may be used for this task.

The ice blocks are bonded to the underlying ice, that is the top of the sheet ice on the specific area at which it is desired to build the ice island. Before the ice blocks are positioned, the ice surface is flooded with water and allowed to form a slush layer. The cured ice blocks are then placed on the slush and the excess water is quickly squeezed out and the slush freezes since the base of the ice blocks is at ambient temperature, such as −25° C. Vertical cracks between the blocks are then flooded with water. If it is found that the water runs out, as between large cracks, the cracks can be filled with saturated snow. The greater the water saturation of the snow, the stronger the resulting bond.

Unlike most other artificial ice construction techniques, such as flooding and spraying, the build-up rate for an ice structure constructed from ice blocks is not strongly dependent on the water freezing rate and the weather conditions. The main construction building material, i.e., the blocks, are already frozen. Because the ice blocks are cured and near ambient temperature, the water used to cement the blocks together also freezes rapidly. Thus, the build-up rate is largely governed by the rate at which the blocks are mined from the ice sheet, cured, and transported and positioned at the site. In the arctic area, island construction will most likely take place during the latter part of November and all of December and January. During this period, the ice will increase in thickness from 2 to 4 feet and have an average thickness of about 3 feet.

In addition to a high build-up rate, ice block structures also have the advantage of lower initial ice temperature and salinity than flooded ice. Under typical winter conditions, the sea ice blocks have an average temperature of about −10° C. and an average salinity of about 6 parts per thousand. For a reference on this, see: "Cox, G. F. N. and Weeks, W. F. (1974), Salinity Variations In Sea Ice. Journal of Glaciology, Vol. 13, no. 67, p. 109–120." In contrast, newly flooded ice constructed from the same sea water has a temperature close to its melting point −2° C. and an average salinity of about 30 parts per thousand. For a reference on this, see: "Dykins, J. E. and Funai, A. J. (1962), Point Barrow Trials—FY 1959. Investigations on Thickened Sea Ice. Naval Civil Engineering Laboratory, Technical Report R189." The sea ice blocks are therefore much stronger. The strength of the ice blocks can be further increased by allowing additional time to cure.

In constructing an ice structure from ice blocks, it is not the ice block strength that is of the most importance, but the strength of the ice block/ice block bond. If fresh or low salinity water is used to bond the blocks together, an ice island of sufficient size would have adequate structural integrity to resist ice movement.

Since the temperature of the sea water and the initial temperature of the sea bed are at the freezing point of sea water, the lower portion of the ice island is warmer and therefore weaker than the overlying ice. The most critical place along which internal shear is most likely to occur as a result of sea ice movement is the bonding layer just above the natural ice layer or the ice sheet. It is expected that the initial salinity of this layer will be about 35 parts per thousand, i.e., sea water salinity. However, since the ice block and the natural sea ice surface will be at ambient temperature most likely below −25° C., the temperature of the bonding layer will be close to the precipitation temperature of NaCl that is 31 23° C. The brine volume of the ice will be small and the ice will have a high strength. After the first layer of ice blocks is frozen to the ice sheet, the bonding layer between the ice blocks and the ice sheet will warm up. As each successive layer of ice blocks is added, the temperature of this critical layer will further increase until the ice structure grounds on the sea floor. This increase is due to having the warmer water underneath it. After grounding, the temperature in the lower portion of the ice island decreases since the underlying soil is cooled by heat conduction through the ice structure.

Figure 9:
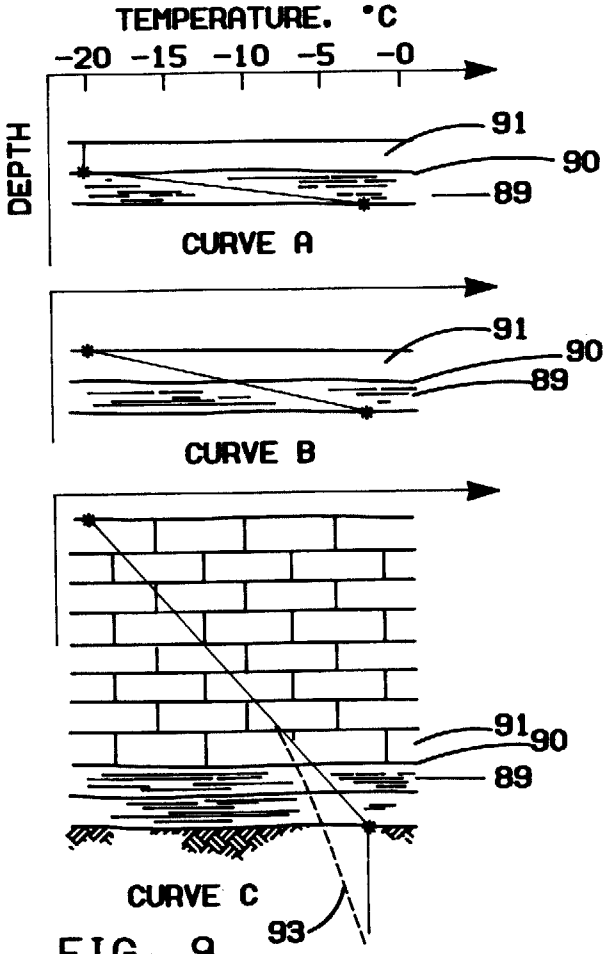
FIG. 9 illustrates variations in temperature of an ice block ice island during construction in water.

The variation in ice temperature during construction of an ice island in 20 feet of water is illustrated in FIG. 9. Maximum possible temperatures (steady-state) are given, assuming a constant ambient temperature of −20° C. The mean temperature during December and January along the north Alaskan coast is about −25° C. Initially, the temperature of the bonding layer 90 between the ice 89 blocks 91 and the natural ice 89 will be about −20° C. (curve A). The ice temperature of the bonding layer will then approach −12° C. before the next layer of blocks is added in an effort to obtain thermal equilibrium (curve B). As the island is constructed, the temperature at all levels increases and approaches the steady-state profile shown by the solid line in curve C just at grounding. The temperature of the critical layer will increase to about −5° C. After grounding, this critical layer will then decrease in temperature by an unknown amount as a result of cooling of the underlying soil. A possible temperature profile sometime after grounding is shown by the dashed line 93 in curve C.

From estimates of constructed ice shear strength and field data, flooded ice having a salinity of 15 parts per thousand and a temperature of −5° C. would have a shear strength of about 30 psi. Based on data obtained by Dykins and Finai (1962), supra, it is assumed that the salinity of the bonding layer 90 will decrease by 50% during construction as a result of brine drainage with the underlying sea water. This shear strength exceeds the estimated required shear strength of 9 psi for a 300 foot diameter ice island to resist internal shear caused by ice movement, i.e., movement of the ice sheet.

One should next consider the bearing capacity of the ice sheet. For example, if a 300 foot diameter ice structure is to be used, over 2000 8×4×2 foot ice blocks will be needed for each ice block layer. As each cubic foot of ice weighs about 57 lbs, the bearing capacity of the natural ice sheet should be examined to determine how the ice block should be positioned. Uncontrolled failure of the ice sheet under concentrated loads may result in flooding of the working area, loss of ice blocks, and make access to the construction site impossible. Thus, I shall now consider a pattern or method in which I will lay the ice blocks on the sheet ice. Assuming that the ice sheet may be regarded as an elastic plate on an elastic foundation, the following approximation has been obtained.

$$P_{cr} = 0.375\,\sigma_f\left(h^2 + 7.8\,a\sqrt[4]{\frac{\gamma}{E}}\,h^{5/4}\right) \tag{1}$$

where $P_{cr}$=load at which the plate cracks,
$\sigma_f$=flexural strength of ice (100 psi),
h=ice thickness,
a=radius of load,
$\gamma$=density of sea water (64.3 pcf), and
E=ice elastic modulus ($3.0\times10^5$ psi).

Figure 10:
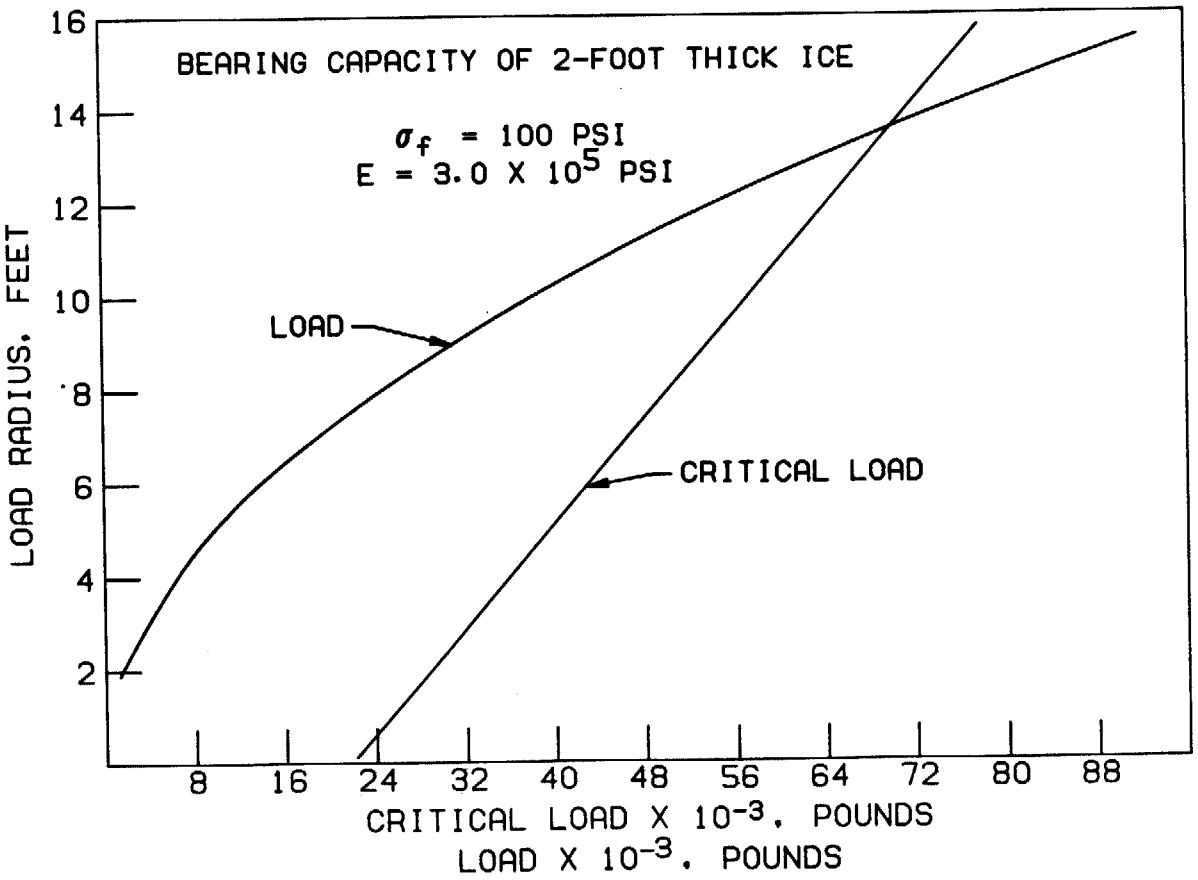
FIG. 10 illustrates varying capacity of a 2-foot-thick sheet ice.

Initially, the natural ice sheet will usually be about 2 feet thick and have a flexural strength of about 100 psi and an elastic modulus of $3.0\times10^5$ psi. The ice blocks mined from the ice sheet will also be 2 feet thick. Equation (1) has been used to estimate how many 8×4×2 ft ice blocks can be positioned on the ice together before the ice sheet cracks. The results are plotted in FIG. 10. An ice block density of 57 pcf was used to calculate the load. FIG. 11 indicates that cracking of the ice sheet will occur once the 2-foot thick ice blocks have been positioned in a circle having a radius of about 14 feet. This area corresponds to only 19 ice blocks, about one percent of the total number of ice blocks required for each layer. Thus, during construction of a 300-foot diameter ice structure, failure of the ice sheet will occur. A plan is devised to minimize ice failure and unwanted flooding in the working area, and cause the ice sheet to fail in a controlled manner outside the perimeter of the area selected for the island.

Figure 5:
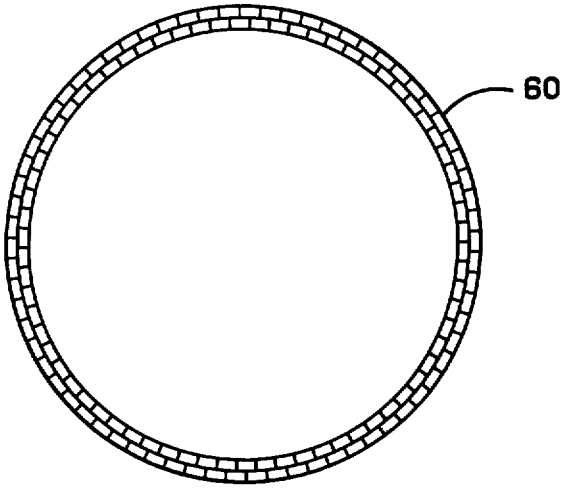
FIG. 5 illustrates an ice block ring outlining the area of an artificial ice island to be constructed.
Figure 6:
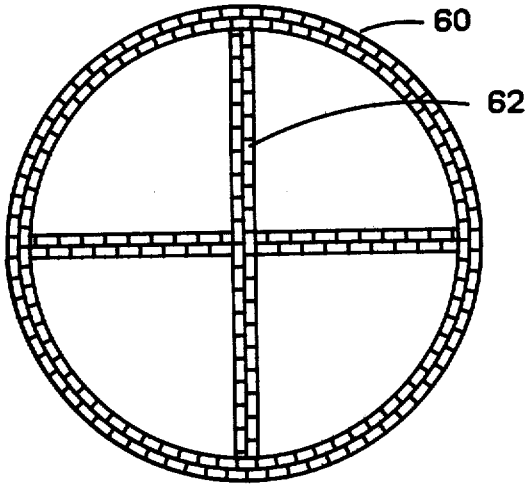
FIG. 6 illustrates dividing the ice ring of FIG. 4 into quadrants.
Figure 7:
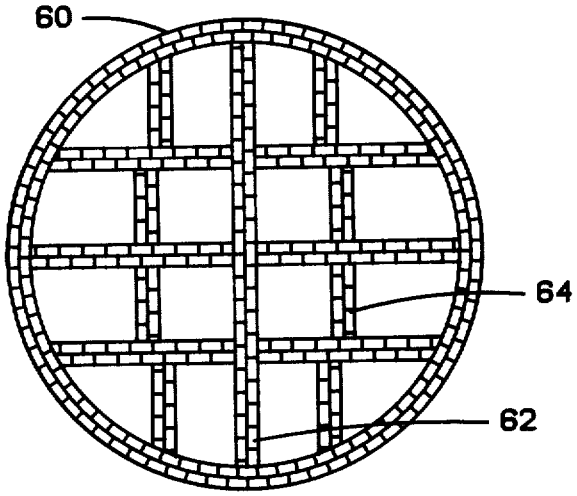
FIG. 7 illustrates subdividing the quadrants of FIG. 6.
Figure 8:
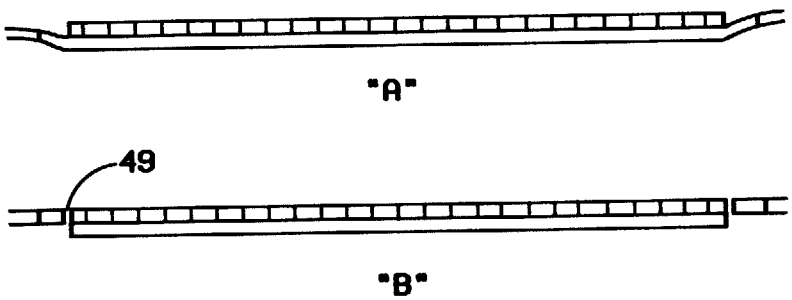
FIG. 8 illustrates cutting slots around the ice block ring to relieve stress.

One solution is to construct a ring of ice blocks and then fill in the interior of the ring in a systematic manner to minimize the deflection of the ice inside the ring. For example, a 300-foot diameter ice ring, several ice blocks wide, would first be constructed as ring 60 on the ice sheet (FIG. 5). Since the ice blocks are distributed over a large area, failure of the ice sheet should not occur. At the same time, a grounded ice block road should be constructed to the ice ring to provide access to the ring surface and interior. The road should be oriented in the direction of least likely ice movement, probably toward the coast. Once the ring and access road have been constructed, the next step is to divide the ring into quadrants by ice block line 62, as in FIG. 6, taking care not to induce cracking in the interior. Each quadrant is then divided into smaller sections (FIG. 7) by ice block lines 64, and so on until the ring interior is completely filled. What is being accomplished is to distribute the load over a large area in a manner that as the section sinks, the distance between adjacent ice block lines is sufficiently short so that failure of the non-covered ice between ice blocks does not fail. During this period, severe deflections will occur in the surrounding natural ice sheet. The deflections can be eliminated by cutting the ring from the surrounding ice (FIG. 8). Illustration A of FIG. 8 shows bending of the ice sheet which may result in cracking of the sea ice, whereas such cracking is prevented in Illustration "B" by cutting a trench or ditch 49 around the island. The ice blocks in the ring should prevent flooding of the interior. Subsequent ice block layers are constructed in a similar manner until the ice structure is grounded on the sea floor. Once the structure has grounded, the ice blocks may be positioned in any convenient manner.

An alternate and possibly better solution is to construct only a small portion of the total area, e.g., 24-foot by 24-foot sections of the submerged part of the ice island, at a time. After the 18 blocks are laid out, a slot would be cut around the blocks to allow them to reach isostatic equilibrium and relieve the stress in the surrounding ice as described above in relation to FIGS. 3 and 4 and then construct neighboring sections in the same manner until the desired ice island area is obtained. Vertical cracks between the sections should freeze due to the large mass of the cold ice blocks. Once the lower portion of the ice island has grounded, the blocks may be positioned in any convenient manner.

As we stated above, in addition to requiring sufficient ice strength to resist ice movement, an ice island must be large enough to have sufficient sliding resistance on the sea floor to prevent movement. The following is an approximation for H the ice island thickness:

$$H > \frac{4\sigma_c h}{\pi\rho_i D\tan\phi} + \frac{\rho_w}{\rho_i}\,d \tag{2}$$

where $\sigma_c$=unconfined compressive sea ice strength,
h=ice thickness,
D=ice island diameter,
d=water depth,
$\rho_i$=constructed ice density (57 pcf),
$\rho_w$=sea water density (64.3 pcf), and
$\phi$=friction angle of the ice on sea floor.

While the above description has been made in great detail, various modifications can be made thereto without departing from the spirit or scope of the invention.

What is claimed is:

1. A method of constructing an artificial ice island in a marine body of water covered by natural sheet ice in subfreezing temperatures, which comprises:

selecting an area for the ice island;

mining blocks of ice from the natural ice sheet outside said selected area;

cooling said fine blocks by storing them in contact with the air;

then using said cured ice blocks to construct a layer of constructed ice directly on said ice sheet of sufficient mass so that the natural ice sheet beneath the ice blocks rests on the bottom of the body of water.

2. A method as defined in claim 1 in which said ice blocks are built up on a section of said selected area and a trench cut between said section and said selected area so that as said ice blocks are added said section sinks to the bottom of said body of water without adding stress to the surrounding ice sheet.

3. A method as defined in claim 2 in which the section for sheet ice of 2 ft or more thickness is in the shape of a rectangle whose side is not over about 14 feet in length.

4. A method as defined in claim 1 including the step of constructing a ring of ice blocks about the periphery of the island area.

5. A method as defined in claim 4 including the step of filling in a grid work of ice blocks in the interior of said ring such that the ice sheet for the selected area sinks before it fails between blocks.

6. A method as defined in claim 5 in which for a given h (ice thickness), the value A (radius of load) is selected such that in accordance with Equation 1, that $P_{cr}$ is less than the strength of the sheet ice.

7. A method as defined in claim 5 which the height of the artificial island is greater than the value of "H" of Equation 2 for a given sheet ice thickness and water depth and ice island diameter so that the island will resist movement of the surrounding ice.

8. A method as defined in claim 2 in which additional sections are constructed adjacent previously constructed sections until the desired size ice island is obtained.

9. An artificial ice island in a body of water comprising:

a layer of natural ice-sheet resting on the bottom of said body of water;

ice blocks stacked on top of said layer so that the top of at least some of the ice blocks extend above the surface of said body of water, said ice blocks are mined from the natural ice sheet surrounding said island and cooled by storing them in contact with the air.

* * * * *